US012583651B2

(12) United States Patent
Bruins et al.

(10) Patent No.: US 12,583,651 B2
(45) Date of Patent: Mar. 24, 2026

(54) DUAL FUNCTIONING STRAW AND DRINK SPOUT

(71) Applicant: Bomber Brands Inc., Sherwood Park (CA)

(72) Inventors: Matthew Edward Bruins, Medicine Hat (CA); Dillon Cody Rosenau, Leduc County (CA); Patrick Chase Cooper, Leduc County (CA); Kyle Charles McKinney, Sherwood Park (CA)

(73) Assignee: Bomber Brands Inc., Sherwood Park (CA)

( * ) Notice: Subject to any disclaimer, the term of this patent is extended or adjusted under 35 U.S.C. 154(b) by 0 days.

(21) Appl. No.: 18/971,763

(22) Filed: Dec. 6, 2024

(65) Prior Publication Data

US 2025/0197072 A1 Jun. 19, 2025

(30) Foreign Application Priority Data

Dec. 13, 2023 (CA) ..... 3222867

(51) Int. Cl.

| | |
|---|---|
| ***B65D 47/06*** | (2006.01) |
| ***A47G 19/22*** | (2006.01) |
| ***B65D 5/74*** | (2006.01) |
| ***B65D 17/44*** | (2006.01) |
| ***B65D 51/22*** | (2006.01) |
| ***B65D 77/28*** | (2006.01) |

(52) U.S. Cl.

CPC ..... *B65D 47/063* (2013.01); *A47G 19/2222* (2013.01); *B65D 5/747* (2013.01); *B65D 17/44* (2018.01); *B65D 51/222* (2013.01); *B65D 51/228* (2013.01); *B65D 77/283* (2013.01); *B65D 2543/00046* (2013.01)

(58) Field of Classification Search

CPC .. B65D 47/063; B65D 77/283; B65D 47/066; B65D 2543/00046; B65D 17/44; B65D 51/228; B65D 5/748; B65D 5/479; B65D 51/222; B65D 5/749; A47G 19/2222

USPC ..... 220/707, 705; 215/229, 388, 389

See application file for complete search history.

(56) References Cited

U.S. PATENT DOCUMENTS

| | | | | |
|---|---|---|---|---|
| 3,268,792 | A * | 8/1966 | Barmherzig | B65D 77/283 220/710 |
| 4,483,464 | A * | 11/1984 | Nomura | B67B 7/26 222/89 |
| 6,427,928 | B1 * | 8/2002 | Hirota | B65D 77/283 239/289 |
| 6,494,332 | B1 * | 12/2002 | Haughton | B65D 77/28 215/388 |
| 2007/0284398 | A1 * | 12/2007 | Baughman | B65D 47/063 222/529 |

* cited by examiner

*Primary Examiner* — Don M Anderson
*Assistant Examiner* — Jennifer Castriotta
(74) *Attorney, Agent, or Firm* — Alix, Yale & Ristas, LLP

(57) ABSTRACT

A beverage drinking apparatus has a container, a spout, a straw and a cap, and allows the user a choice of drinking method. When the user turns the cap in a first direction, the straw extends from spout for the user to drink from. When the user turns the cap in a second direction, the straw is removed from the container, allowing the user to drink from the spout.

6 Claims, 5 Drawing Sheets

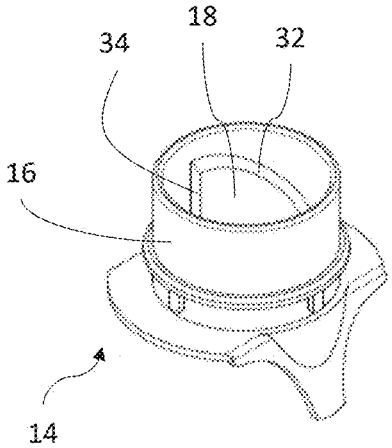
FIG. 4
FIG. 5
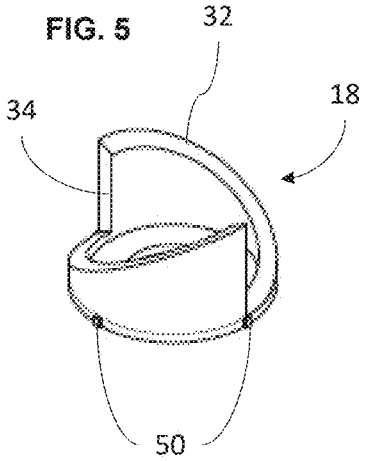
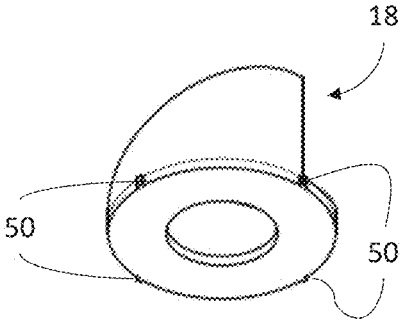
FIG. 6
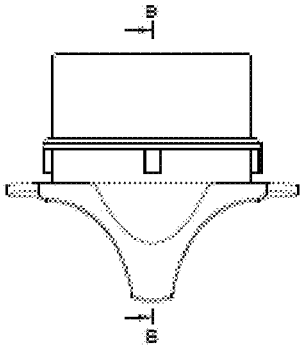
FIG. 7
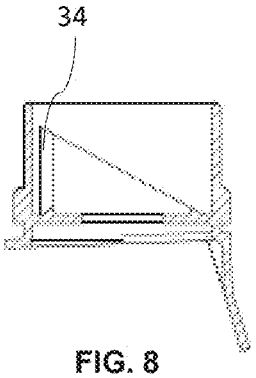
FIG. 8

DUAL FUNCTIONING STRAW AND DRINK SPOUT

FIELD OF THE DISCLOSURE

The present disclosure relates to drinking containers, in particular, for pre-packaged beverage containers.

BACKGROUND

The background description includes information that may be useful in understanding the present inventive subject matter. It is not an admission that any of the information provided herein is prior art or applicant admitted prior art, or relevant to the presently claimed inventive subject matter, or that any publication specifically or implicitly referenced is prior art or applicant admitted prior art.

Prepackaged, single use beverage containers, specifically juice boxes, have followed a generally regimented design since inception in the early 1980s. They are often sold with a plastic wrapped plastic straw, a "peel away" non-spouted flat top, or a "twist off" lid drinking spout, none of which is provided currently in market as multiple drinking options to the consumer on a single container. This provides challenges to beverage and packaging manufacturers to choose a single drinking option for their product(s) and guess which option the customer is likely to prefer. Current options are antiquated and can provide significant challenges to producers and consumers alike.

For the customer, a typical drink box having a plastic straw involves having to carefully unwrap the straw, meticulously aligning the straw to the small hole, and puncturing the aluminum seal, all without breaking the straw.

For manufacturers, plastic laws are creating challenges to cut down on their plastic consumption to mitigate global reliance on non-renewable materials. Plastic straws sealed in plastic, or plastic lids with plastic spouts are being banned in most countries. Paper straws have been introduced to the market as an alternative, but they do not solve the problem long term. Moreover, they get soggy and do not work as intended if left in liquid for an extended period.

Most traditional juice box/straw or twist cap design packaging cannot be utilized for alcoholic beverages as they generally do not meet requirements of single use containers that must be properly sealed for sale, then unsealed when served by a licensed establishment to the consumer. While most cans and glass bottles meet these criteria, and can be recycled, there is still a heavy environmental burden as all empty cans/bottle are shipped in their final form and occupy a tremendous amount of space in cargo containers/trailers. Utilizing a flat pack, juice box style drinking vessel with a nozzle solves those challenges and reduces carbon impact across supply chain of the product. The less cargo containers to transport, the less trucks are needed to deliver the product.

If a restaurant or licensed establishment wishes to offer straws to their patrons as an option for consumption of their beverages, they must source the straws independent of their standard drinkware. And as mentioned above, they will most likely be paper straws, which have the above-mentioned drawbacks.

As mentioned above, specifically relating to juice box straws, one requires certain physical capabilities to properly align and puncture the aluminum foil seal without breaking the straw. People with certain disabilities rely on straws to consume their daily nutrient requirements. Physical limitations may prevent the consumer from accessing the contents of a traditional straw/juice box combination.

There are numerous articles and research papers that have been published suggesting health benefits to using straws or similar devices as a means for drinking as they cut down, or in some cases eliminate, user risks of such health complications as oral infection from contaminated aluminum cans, glasses or other drinkware, gingivitis from sugary beverages filtered through the front teeth, and tooth decay or staining.

Straw and juice box designs have evolved in the previous decades with manufacturers incorporating changes to packaging designs, materials, and ingestion options for their customers. However, there remains a need for a single-use container which has both a straw and twist cap as options.

In some embodiments, the numbers expressing quantities of ingredients, properties such as concentration, reaction conditions, and so forth, used to describe and claim certain embodiments of the inventive subject matter are to be understood as being modified in some instances by the term "about." Accordingly, in some embodiments, the numerical parameters set forth in the written description and attached claims are approximations that can vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the inventive subject matter are approximations, the numerical values set forth in the specific examples are reported as precisely as practicable. The numerical values presented in some embodiments of the inventive subject matter may contain certain errors necessarily resulting from the standard deviation found in their respective testing measurements.

Unless the context dictates the contrary, all ranges set forth herein should be interpreted as being inclusive of their endpoints and open-ended ranges should be interpreted to include only commercially practical values. Similarly, all lists of values should be considered as inclusive of intermediate values unless the context indicates the contrary.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

The recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (e.g., "such as") provided with respect to certain embodiments herein is intended merely to better illuminate the inventive subject matter and does not pose a limitation on the scope of the inventive subject matter otherwise claimed. No language in the specification should be construed as indicating any non-claimed element essential to the practice of the inventive subject matter.

Groupings of alternative elements or embodiments of the inventive subject matter disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified thus fulfilling the written description of all Markush groups used in the appended claims.

SUMMARY

The present disclosure is directed to an apparatus comprising a hollow container having an opening; a spout having a spout interior and a spout base, the spout base being attached to the opening of the hollow container; a collapsible straw attached to the spout interior; a cap removably attached to the spout; wherein the collapsible straw is removably secured to the inside of the cap; wherein turning the cap in a first direction separates the cap from the spout and extends the collapsible straw outwards from the spout; and wherein turning the cap in a second direction separates the spout interior from the spout, thus allowing the spout interior and the collapsible straw to be removed from the container with the cap.

In one embodiment, the cap includes a cap interior, the cap interior being adjacent to the spout interior when the cap is attached to the spout, wherein when the cap is turned in said first direction the cap interior rotates away from the spout interior, and wherein when the cap is turned in said second direction the cap interior rotates with the spout interior.

In a preferred embodiment, each of the cap interior and the spout interior include at least one mating element, the at least one mating element includes a curved ramp portion ending in a flat longitudinal portion, whereby the flat longitudinal portion of the cap interior is adjacent to the flat longitudinal portion of the spout interior when the cap is attached to the spout, thereby: when the cap is turned in said first direction the curved ramp portion of the cap interior engages the curved ramp portion of the spout interior, thus rotating the cap interior away from the spout interior, and wherein when the cap is turned in said second direction the flat longitudinal portion of the cap interior abuts against the flat longitudinal portion of the spout interior, thus rotating the cap interior with the spout interior.

In a preferred embodiment the cap includes threading to allow the spout and the cap to be re-attached after being separated.

In one embodiment the collapsible straw is removably attached to the cap with a food grade adhesive.

In a preferred embodiment the spout interior is removably connected to the spout with break-away tabs.

Another embodiment is directed to an apparatus for use with a hollow container having an opening, the apparatus comprising a spout having a spout interior and a spout base, the spout base being attached to the opening of the hollow container, a straw having a collapsible top section, a rigid lower section extending into the container, and an attachment point in between the top section and the lower section; a cap removably attached to the spout; wherein the collapsible top section is removably secured to the inside of the cap; wherein turning the cap in a first direction separates the cap from the spout and extends the collapsible top section of the straw outwards from the spout; and wherein turning the cap in a second direction separates the spout interior from the spout, thus allowing the spout interior and the straw to be removed from the container with the cap.

Various objects, features, aspects and advantages of the inventive subject matter will become more apparent from the following detailed description of preferred embodiments, along with the accompanying drawing figures in which like numerals represent like components.

BRIEF DESCRIPTION OF THE DRAWINGS

The present disclosure will be better understood having regard to the drawings in which:

FIG. 4 shows one embodiment of the spout and the spout interior.

FIG. 5 shows a perspective view of one embodiment of the spout interior.

FIG. 6 shows a lower perspective view of the embodiment of FIG. 5.

FIG. 7 shows a side view of the embodiment of FIG. 4.

FIG. 8 shows a cross-sectional view of the embodiment of FIG. 7, taken along the line B-B.

DETAILED DESCRIPTION OF THE DRAWINGS

As can be seen in the Figures, an embodiment of the present invention includes an apparatus 10, which includes a container 12, a spout 14 and a cap 20.

Figure 1:
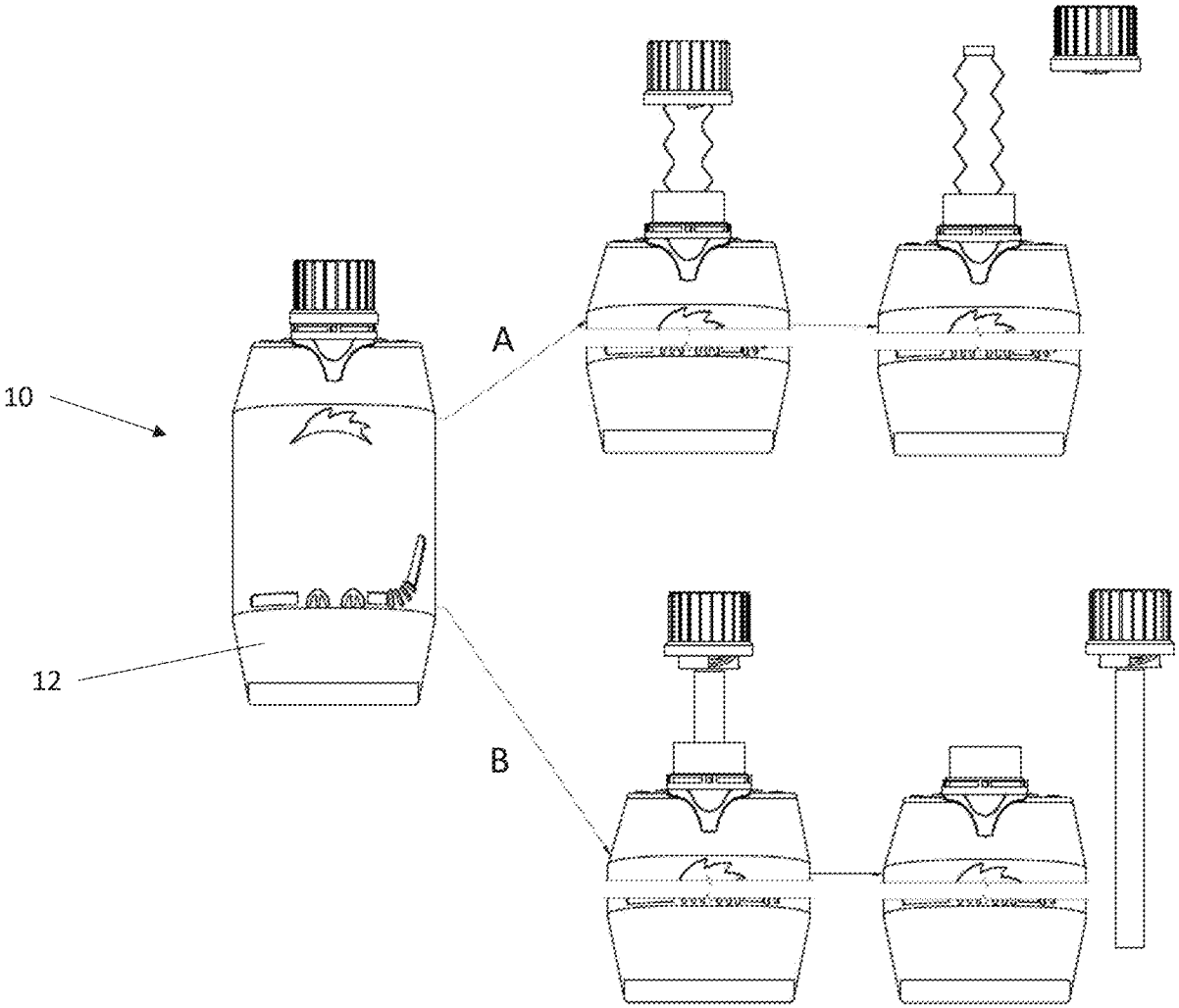
FIG. 1 shows one embodiment of the invention, having two drinking options, dependent upon which way the cap is turned.

When the cap 20 is turned in a first direction by the user, a straw 24 extends from the spout 14. The cap 20 can be removed from the end of the straw 24 and the user can then drink through the straw 24. This can be seen in FIG. 1.

Figure 2:
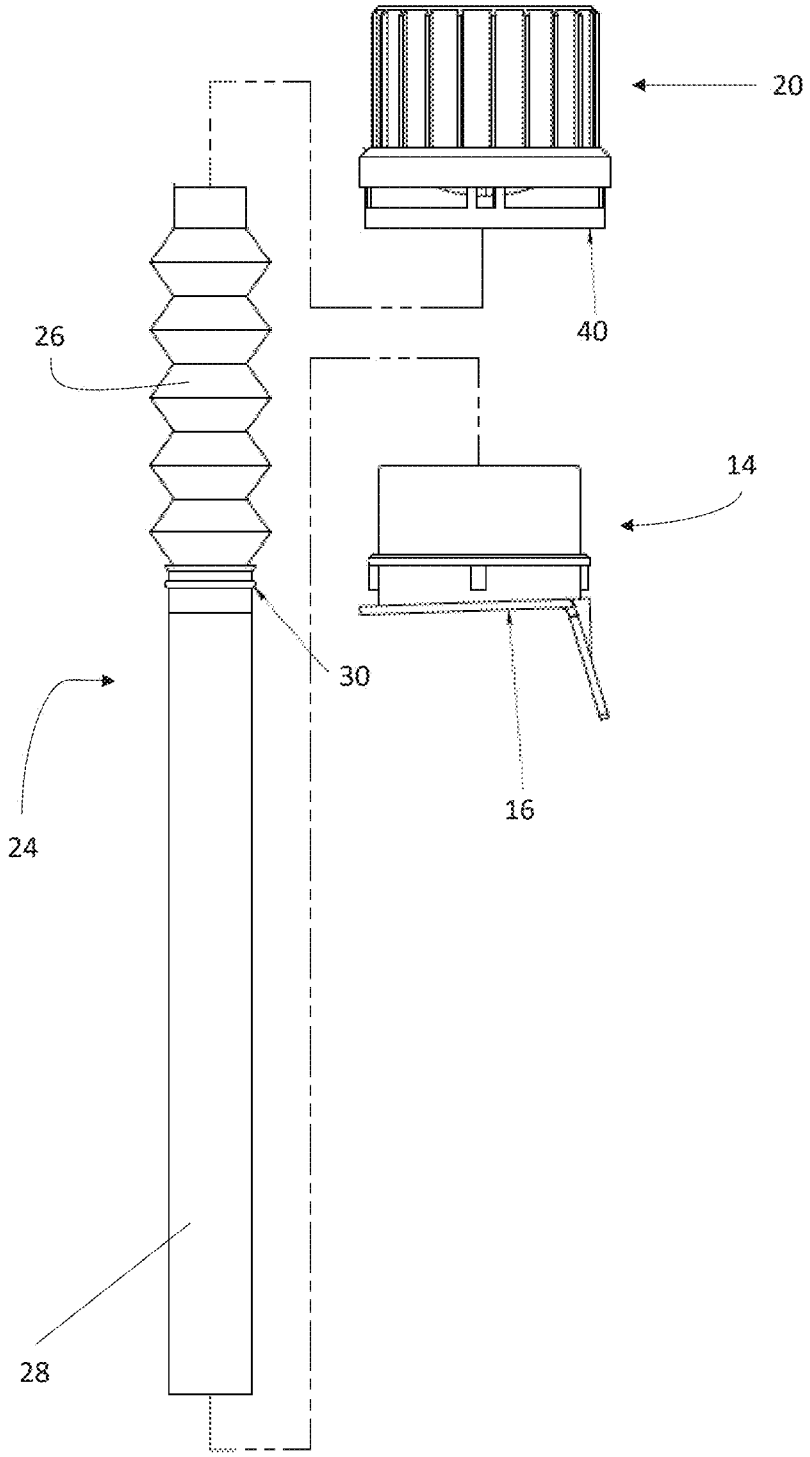
FIG. 2 shows an exploded view of the straw, the spout and the cap of one embodiment of the present invention.
Figure 3A:
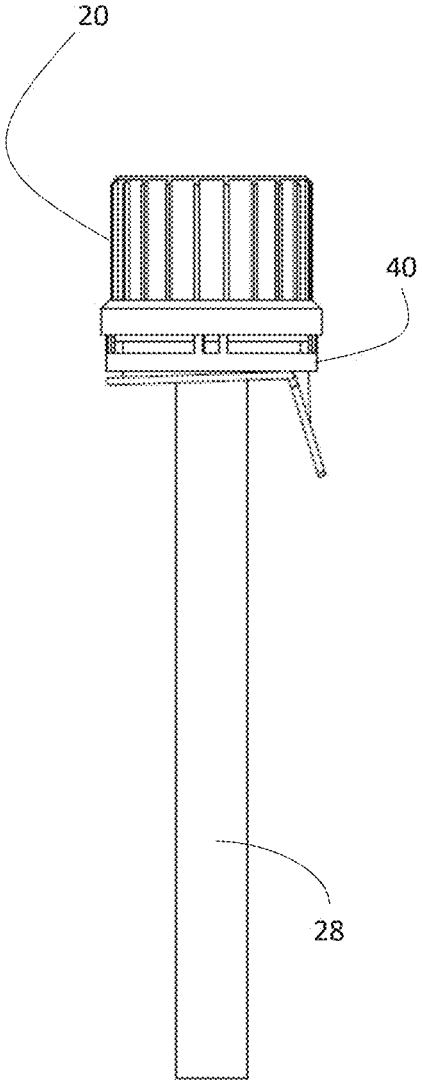
FIG. 3A shows an assembled view of the embodiment of FIG. 2.
Figure 3B:
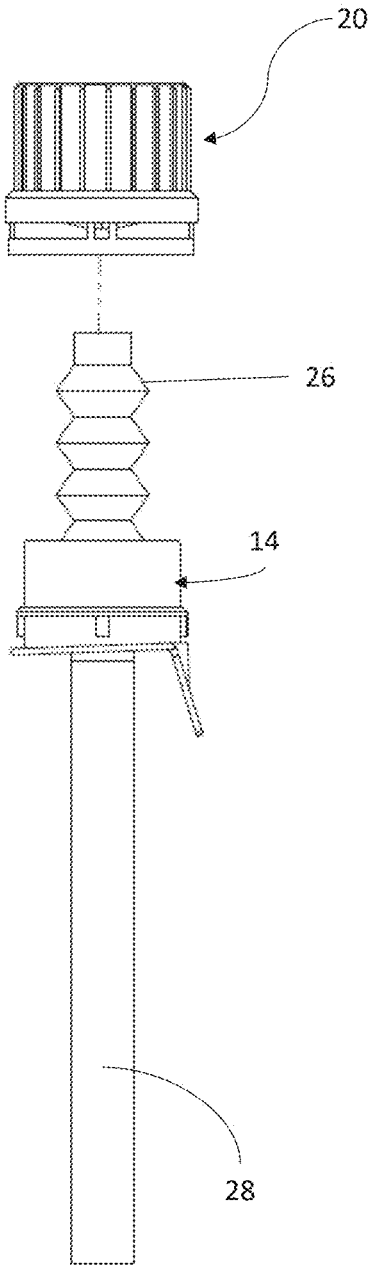
FIG. 3B shows a partially exploded view of the embodiment of FIG. 3A, with the cap removed.
Figure 9:
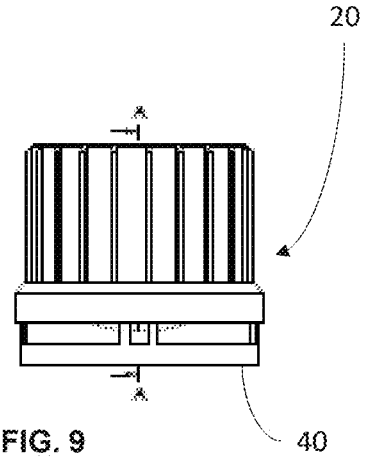
FIG. 9 shows a side view of an embodiment of the cap.
Figure 10:
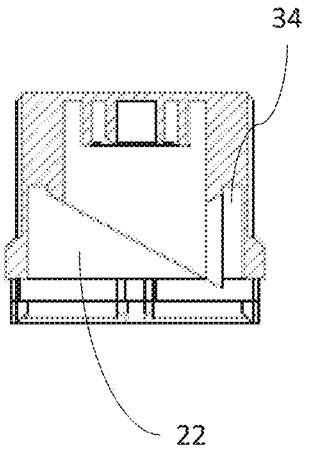
FIG. 10 shows a cross-sectional view of the embodiment of FIG. 9, taken along the line A-A.
Figure 11:
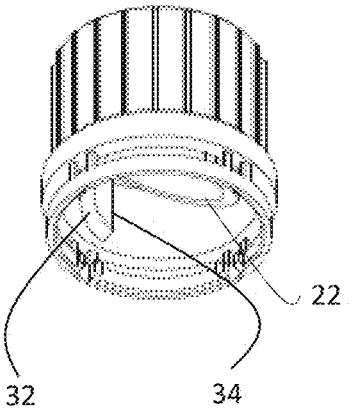
FIG. 11 shows a perspective view of one embodiment of the cap and the cap interior.

When the cap 20 is turned in a second direction, the straw 24 separates from the spout 14, and is removable from the container 12. The user can then drink from the container 12 through the spout 14. FIGS. 2, 3A and 3B show the cap 20 removed, along with the straw 24.

This is accomplished in one embodiment by elements further described herein, and as can be seen in FIGS. 4-11.

In one embodiment, spout 14 includes a spout base 16 and a spout interior 18. The spout interior 18 is removably connected to the spout base 16 by multiple break-away tabs 50. Similarly, cap 20 includes cap interior 22.

As can be seen in FIGS. 4-6, spout interior 18 includes two curved sections 32, each having a flat longitudinal portion 34. The cap interior 22 has a similar profile but inverted, so that when they are combined, the flat longitudinal portions of the spout interior 18 abut against the flat longitudinal portions of the cap interior 22.

It should be noted that although this embodiment, and FIGS. 5 and 6, shows the spout interior 18 and cap interior 22 having two curved sections 32, that it could be within the scope of the invention to have only one curved section 32, or to have more than two sections.

Also seen in FIG. 2 is the straw 24, which includes an extendable top portion 26, a rigid lower portion 28, and an attachment point 30.

In one embodiment, as assembled, the straw 26 is sealed at the attachment point 30 to the spout interior 18, preferably with a food safe adhesive. In one embodiment, the attachment point 30 is removably attached to the spout interior 18, and the straw 26 can be separated from the spout 14.

In one embodiment, the top of the straw 26 is then also sealed to the inside of the cap 20, also preferably with food safe adhesive. The cap 20 is then pressed downwards, collapsing the top section of the straw 26 until the cap 20 is connected to the spout 14 by a tamper-seal ring 40. Tamper-seals are well known in the industry.

In another embodiment, the top of the straw 26 is attached to the inside of the cap 20 by a pressure fitment, thus securing the straw to the cap, but allowing for them to be separated when necessary.

This combination of the spout 14, the straw 24 and the cap 20 is best seen in FIGS. 2 and 3. Once container 12 is filled, this combination is then inserted into the opening of container 12 and sealed thereto.

One embodiment of the apparatus 10 will now be described, and makes reference to elements shown in FIGS. 4 to 11.

As mentioned above, when the cap 20 is secured to the spout 14, the spout interior 18 will be mated with the cap interior 22 in such a way that flat longitudinal portions 34 from the spout interior will abut against the flat longitudinal portions of the cap interior.

Thus, when the user turns the cap 20 in a first direction, the flat longitudinal portions 34 will move away from each other, and the curved sections 32 will engage each other. As the cap 20 rotates, curved sections 32 will force the cap upwards, separating the cap interior 22 away from the spout interior 18, which is held in place, connected to the spout base 16, by break-away tabs 50. and breaking the tamper-seal ring 40.

Once the tamper-seal ring 40 is broken, the user will be able to pull on the cap 20, thus extending the top section 26 of the straw 24. This can be seen in option "A" of FIG. 1. After the straw 24 has extended, the cap 20 can be separated from the straw 24, and the user can drink the beverage freely using the straw 24.

Instead, if the user were to turn the cap 20 in a second direction, the flat longitudinal portions 34 from the cap interior 22 will abut the flat longitudinal portions from the spout interior 18. As cap 20 continues to turn in the second direction, the break-away tabs 50 will break, thus severing the connection between the spout interior 18 and the spout base 16.

Once the break-away tabs 50 are broken, the user will be able to pull cap 20 upwards. This will pull the spout interior 18, along with the entire straw 24, free from the spout base 16, and separated from container 12. This can be seen in option "B" of FIG. 1. Once separated, the user can drink the beverage freely using the spout 14.

Figure 12:
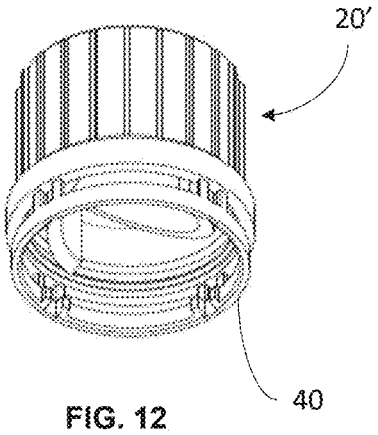
FIG. 12 shows a perspective view of an alternate embodiment of the cap and cap interior.
Figure 13:
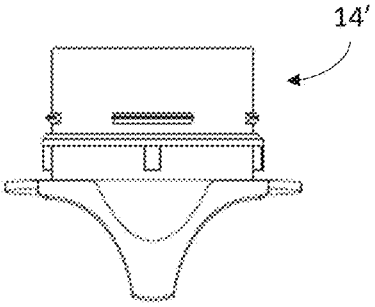
FIG. 13 shows a side view of an alternate embodiment of the spout, which mates with the cap of FIG. 12.

In one embodiment of the invention the spout base 16 and the cap 20' would include threading to allow for the cap to be re-attached to the spout 14'. In this embodiment, if the user chose option "B" and wanted to drink from the spout, they would separate the straw 24 and cap 20' from the container and then separate the cap from the straw 24. At this point, should they want to re-attach the cap 20' to the spout 14' so that they can enjoy the remainder of their beverage at a later moment, they could do so. One example of such threading is shown in FIGS. 12 and 13, but other embodiments that perform a similar function would fall under the scope of the invention.

The embodiments described herein are examples of structures, systems or methods having elements corresponding to elements of the techniques of this application. This written description may enable those skilled in the art to make and use embodiments having alternative elements that likewise correspond to the elements of the techniques of this application. The intended scope of the techniques of this application thus includes other structures, systems or methods that do not differ from the techniques of this application as described herein, and further includes other structures, systems or methods with insubstantial differences from the techniques of this application as described herein.

In differing embodiments, the apparatus may be made 100% of plant-based materials, in compliance with regulatory requirements. In other embodiments, the apparatus may be made from traditional plastics, within those jurisdictions that allow for such usage. These differing materials all fall within the scope of the present invention.

Moreover, the previous detailed description is provided to enable any person skilled in the art to make or use the present invention. Various modifications to those embodiments will be readily apparent to those skilled in the art, and the generic principles defined herein may be applied to other embodiments without departing from the spirit or scope of the invention described herein. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims.

The above description provides many example embodiments of the inventive subject matter. Although each embodiment represents a single combination of inventive elements, the inventive subject matter is considered to include all possible combinations of the disclosed elements. Thus, if one embodiment comprises elements A, B, and C, and a second embodiment comprises elements B and D, then the inventive subject matter is also considered to include other remaining combinations of A, B, C, or D, even if not explicitly disclosed.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification or claims refer to at least one of something selected from the group consisting of A, B, C . . . and N, the text should be interpreted as requiring only one element from the group, not A plus N, or B plus N, etc.

What is claimed is:

1. An apparatus comprising:

a hollow container having an opening;

a spout having a spout interior and a spout base, the spout base being attached to the opening of the hollow container;

a collapsible straw attached to the spout interior;

a cap removably attached to the spout;

wherein the collapsible straw is removably secured to the inside of the cap;

wherein turning the cap in a first direction separates the cap from the spout and extends the collapsible straw outwards from the spout; and wherein turning the cap in a second direction separates the spout interior from the spout, thus allowing the spout interior and the collapsible straw to be removed from the container with the cap.

2. The apparatus of claim 1, wherein the cap includes a cap interior member, the cap interior member being adjacent to the spout interior when the cap is attached to the spout, wherein when the cap is turned in said first direction the cap interior rotates away from the spout interior, and when the cap is turned in said second direction the cap interior rotates with the spout interior.

3. The apparatus of claim 2, wherein each of the cap interior and the spout interior includes at least one mating element, the at least one mating element includes a curved ramp portion ending in a flat longitudinal portion, whereby the flat longitudinal portion of the cap interior is adjacent to the flat longitudinal portion of the spout interior when the cap is attached to the spout, thereby:

when the cap is turned in said first direction the curved ramp portion of the cap interior engages the curved ramp portion of the spout interior, causing rotation of the cap interior away from the spout interior, and when the cap is turned in said second direction the flat longitudinal portion of the cap interior abuts against the flat longitudinal portion of the spout interior, causing rotation of the cap interior with the spout interior.

4. The apparatus of claim 1, wherein the collapsible straw is removably attached to the cap with a food grade adhesive.

5. The apparatus of claim 1, wherein the spout interior is removably connected to the spout with break-away tabs.

6. An apparatus for use with a hollow container having an opening, comprising:

a spout having a spout base attached to the opening of the hollow container;

a straw having:

a collapsible top section;

a rigid lower section extending into the container; and an attachment point in between the top section and the lower section, where the attachment point is connected to an interior of the spout;

a cap removably attached to the spout, wherein the collapsible top section is removably secured to an inside of the cap, turning the cap in a first direction separates the cap from the spout and extends the collapsible top section of the straw outwards from the spout, and turning the cap in a second direction separates the attachment point of the straw from the interior of the spout, thereby allowing the straw to be removed from the container with the cap.

* * * * *